US012201195B2

(12) United States Patent
Konaka et al.

(10) Patent No.: US 12,201,195 B2
(45) Date of Patent: Jan. 21, 2025

(54) SLIDE FASTENER AND METHOD OF PRODUCING WATERPROOF CHAIN

(71) Applicant: YKK Corporation, Tokyo (JP)

(72) Inventors: Toshimasa Konaka, Kurobe (JP); Takayuki Ogyu, Kurobe (JP); Mamoru Usuda, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/221,544

(22) Filed: Jul. 13, 2023

(65) Prior Publication Data

US 2024/0108105 A1 Apr. 4, 2024

(30) Foreign Application Priority Data

Oct. 3, 2022 (JP) ..... 2022-159609

(51) Int. Cl.
*A44B 19/32* (2006.01)
*A44B 19/34* (2006.01)

(52) U.S. Cl.
CPC ..... *A44B 19/32* (2013.01); *A44B 19/343* (2013.01); *A44B 19/346* (2013.01)

(58) Field of Classification Search
CPC ..... A44B 19/32; A44B 19/343; A44B 19/346
See application file for complete search history.

(56) References Cited

U.S. PATENT DOCUMENTS

| | | | | |
|---|---|---|---|---|
| 4,580,321 | A * | 4/1986 | Tanikawa | A44B 19/32 24/384 |
| 6,343,408 | B1 * | 2/2002 | Neugebauer | A44B 19/32 24/392 |
| 6,427,294 | B1 | 8/2002 | Shibaike et al. | |
| 10,130,149 | B1 * | 11/2018 | Liping | A44B 19/346 |
| 2008/0189918 | A1 | 8/2008 | Kusayama | |

FOREIGN PATENT DOCUMENTS

| | | | |
|---|---|---|---|
| JP | 3580725 | B2 | 10/2004 |
| JP | 4689631 | B2 | 5/2011 |
| WO | 2021/048936 | A1 | 3/2021 |

* cited by examiner

*Primary Examiner* — Robert Sandy
(74) *Attorney, Agent, or Firm* — Procopio, Cory, Hargreaves & Savitch LLP

(57) ABSTRACT

A slide fastener includes a pair of waterproof stringers comprising a pair of woven and/or knitted fastener tapes, a pair of coil elements respectively secured to opposing side-edge portions of the pair of fastener tapes, and waterproof films respectively overlaid via adhesives on tape top surfaces of the fastener tapes of the pair of fastener tapes, and a slider that moves forward to engage the pair of coil elements and moves rearward to disengage the pair of coil elements. Each of the waterproof films has a film edge positioned over a space between the opposing side-edge portions of the pair of fastener tapes, the film edge supported by a supporting portion made of the adhesive solidified, the supporting portion partially occupying the space between the opposing side-edge portions of the pair of fastener tapes, and the supporting portion having a thickness greater than a thickness of the film edge.

20 Claims, 9 Drawing Sheets

[Figure 1]
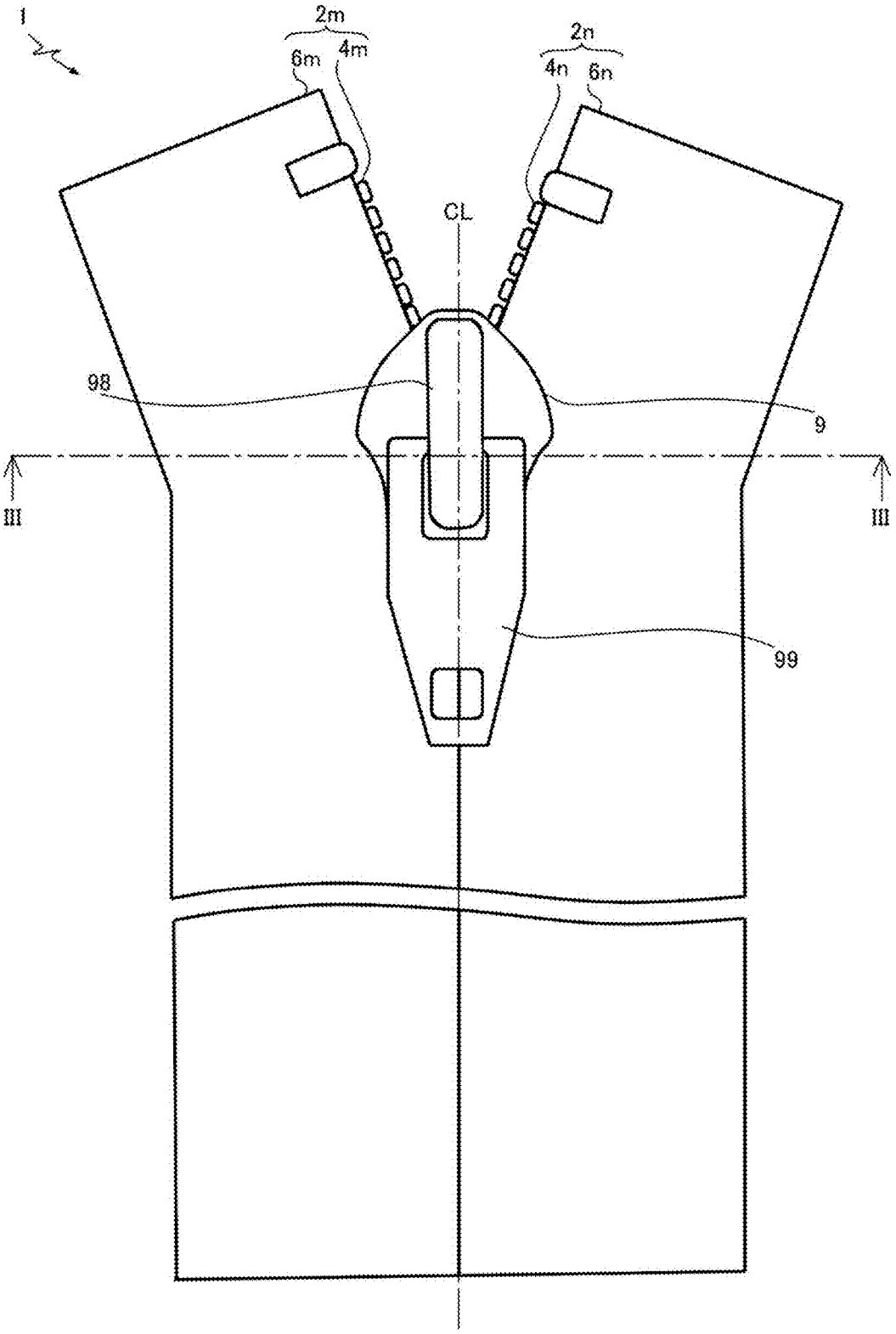

[Figure 2]
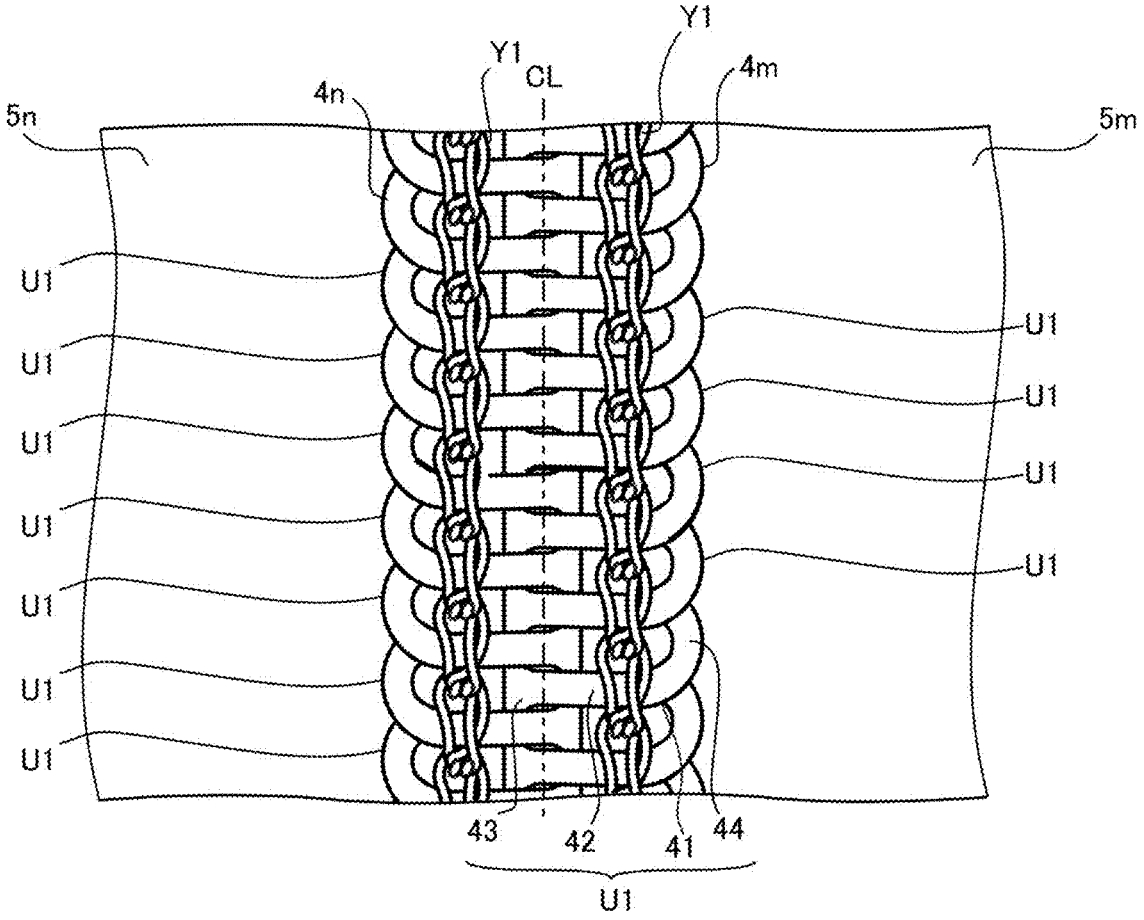

[Figure 3]
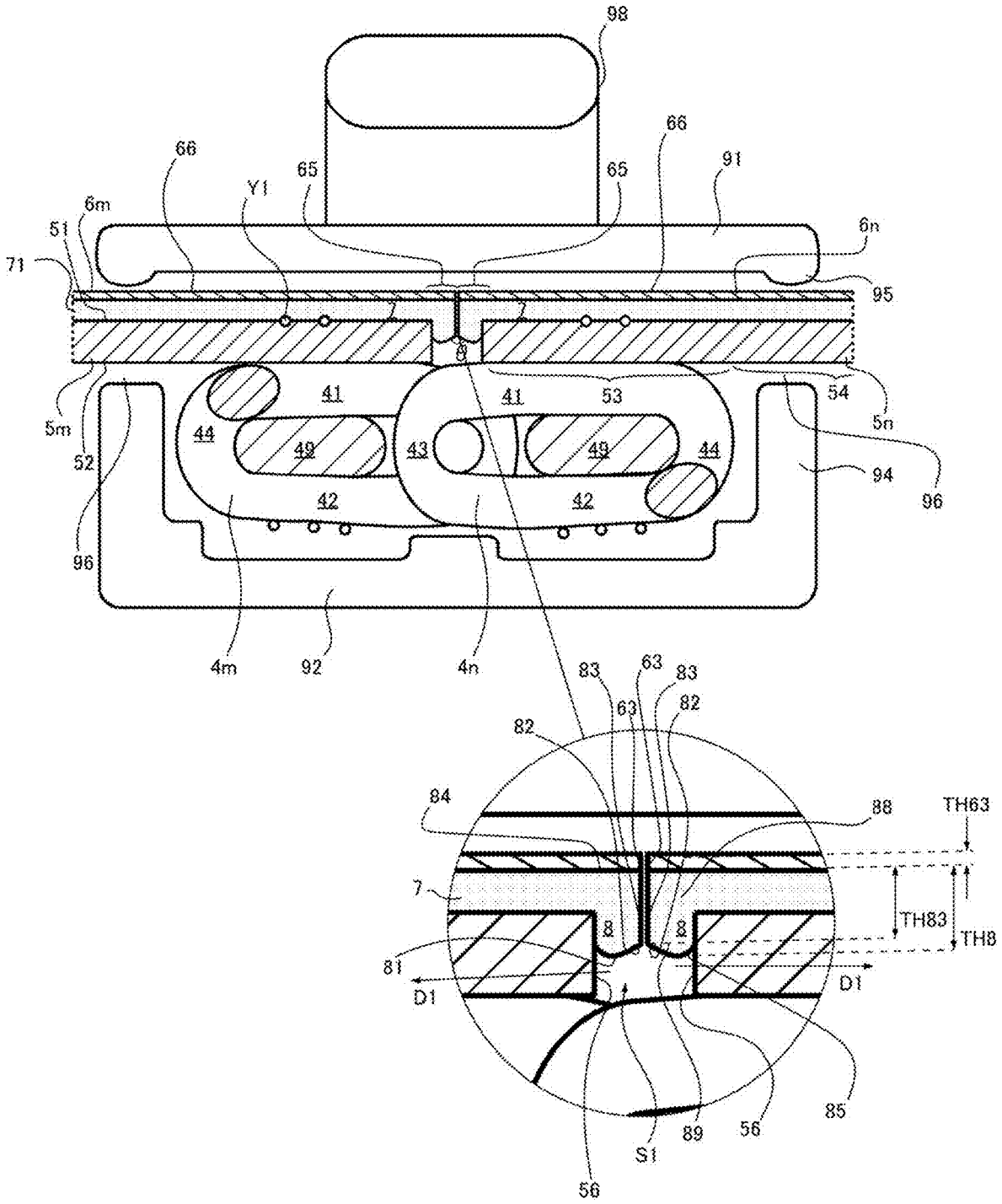

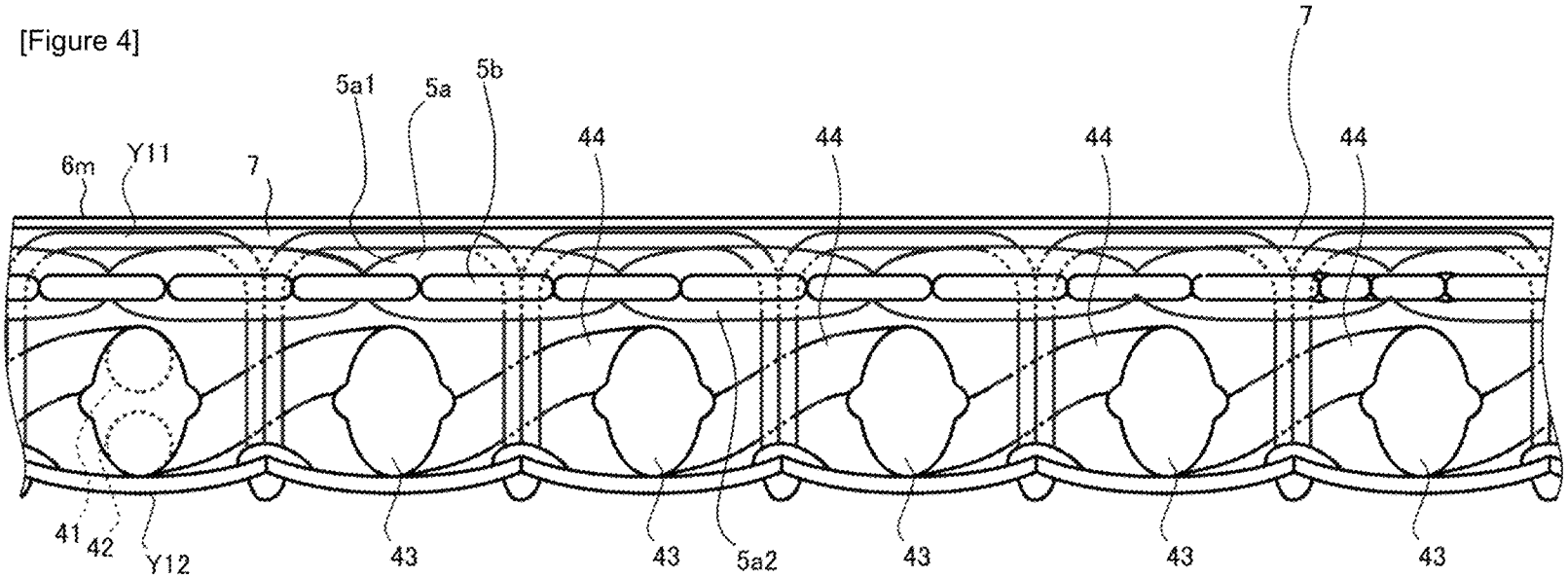
[Figure 4]

[Figure 5]
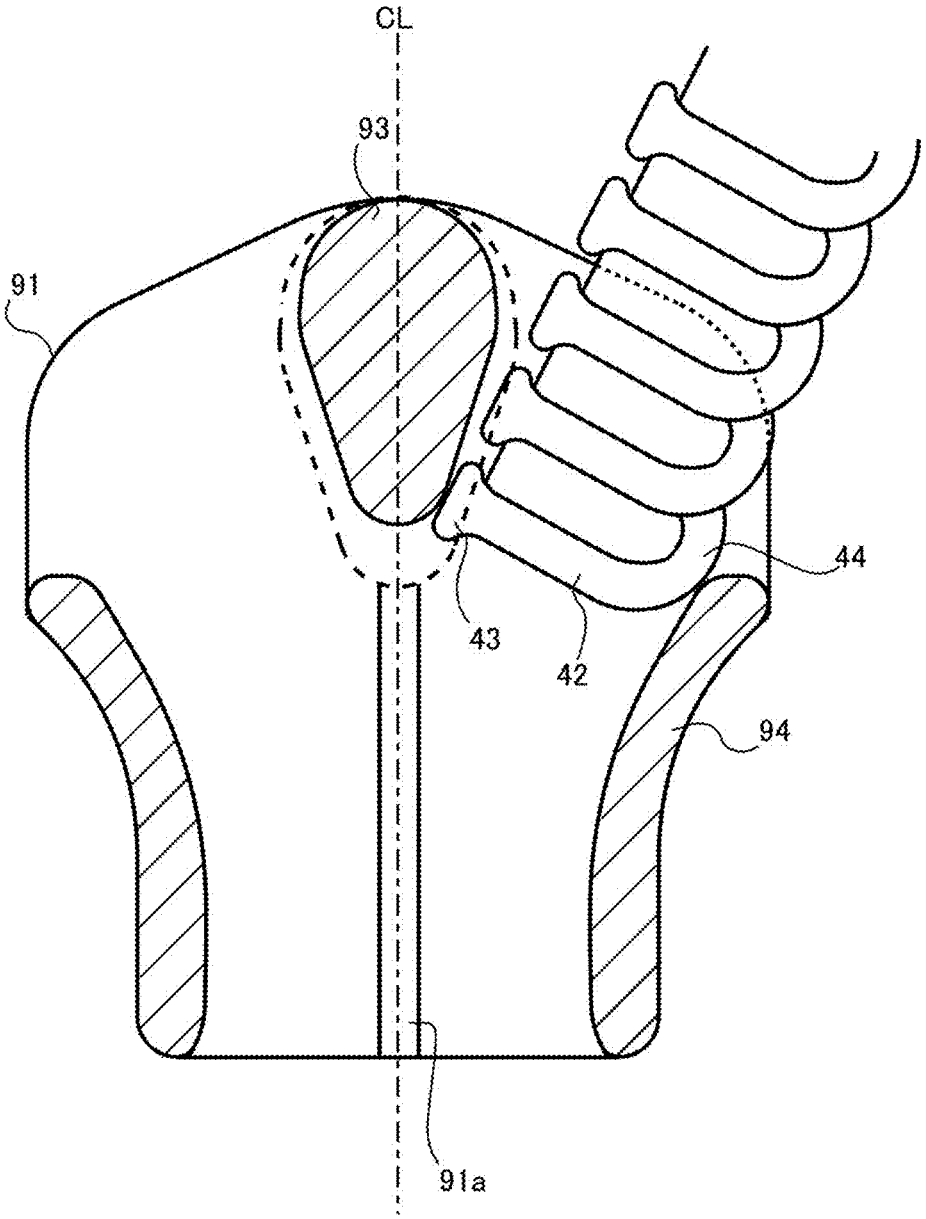

[Figure 6]
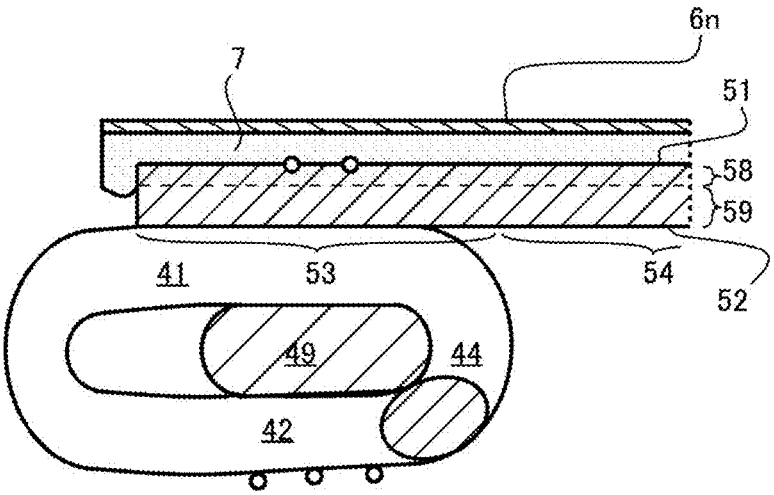
[Figure 7]
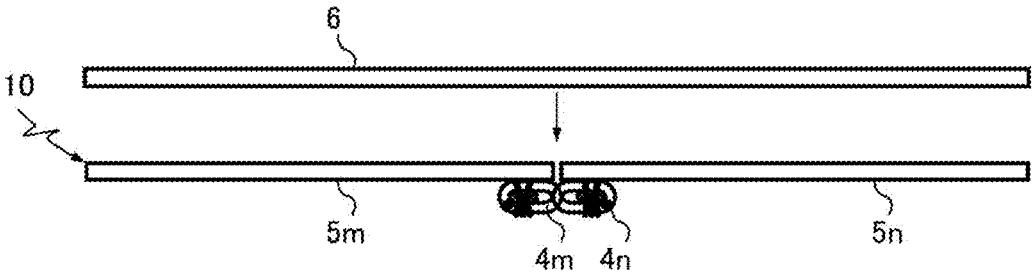
[Figure 8]
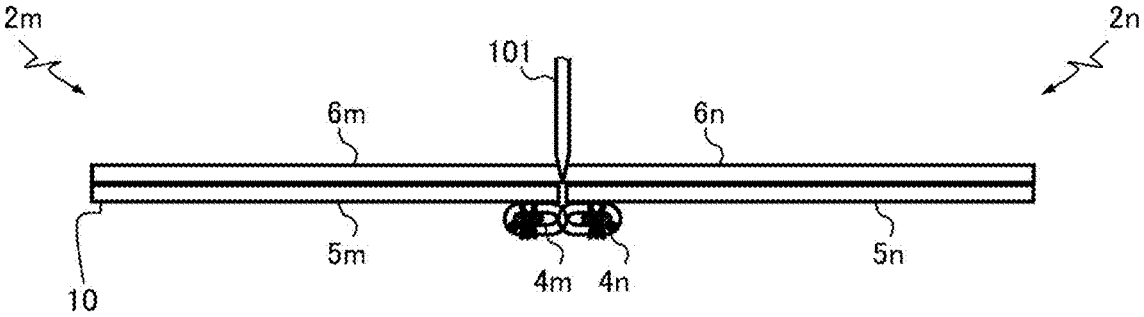

[Figure 9]
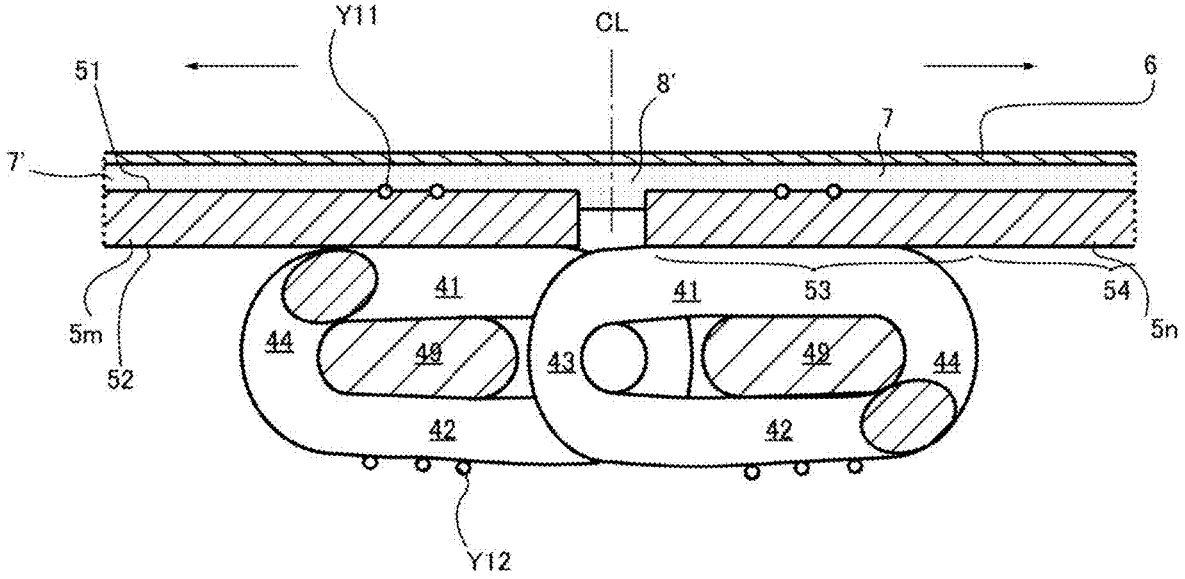
[Figure 10]
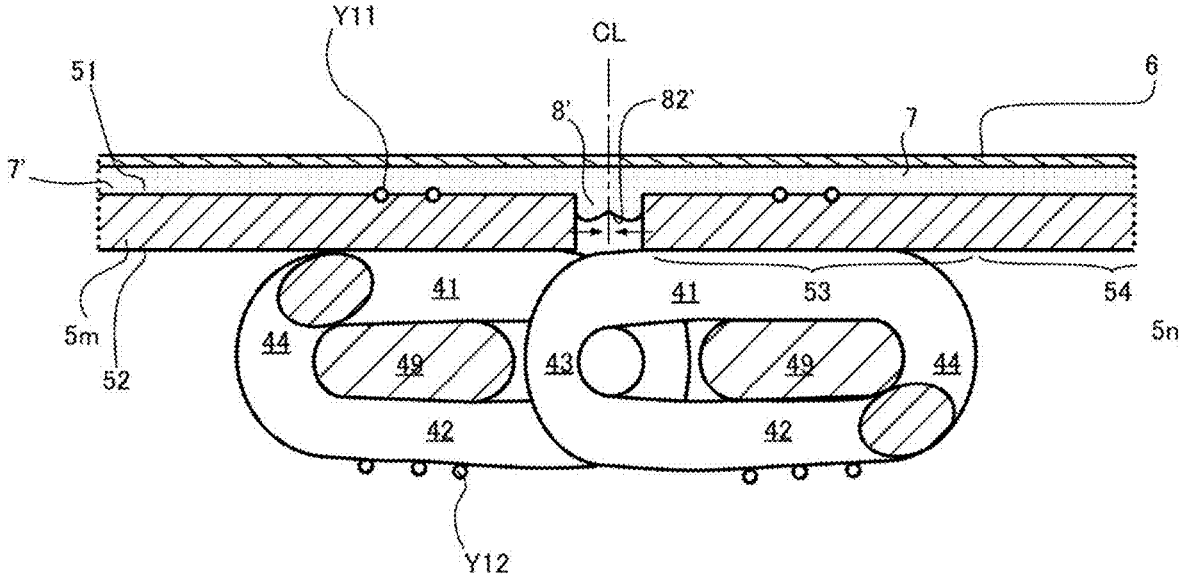

[Figure 11]
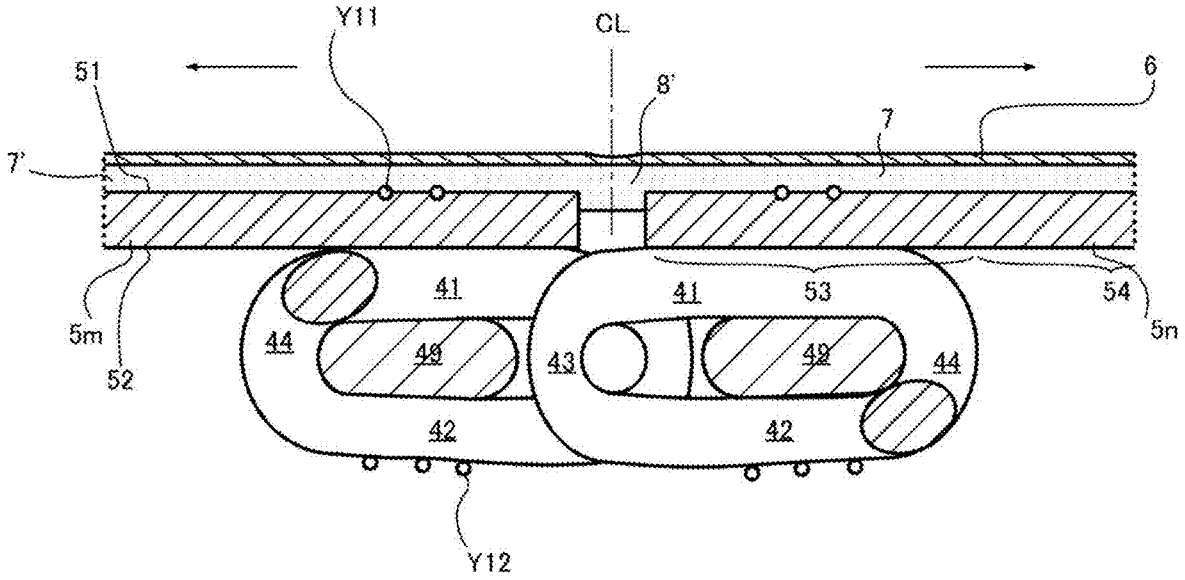
[Figure 12]
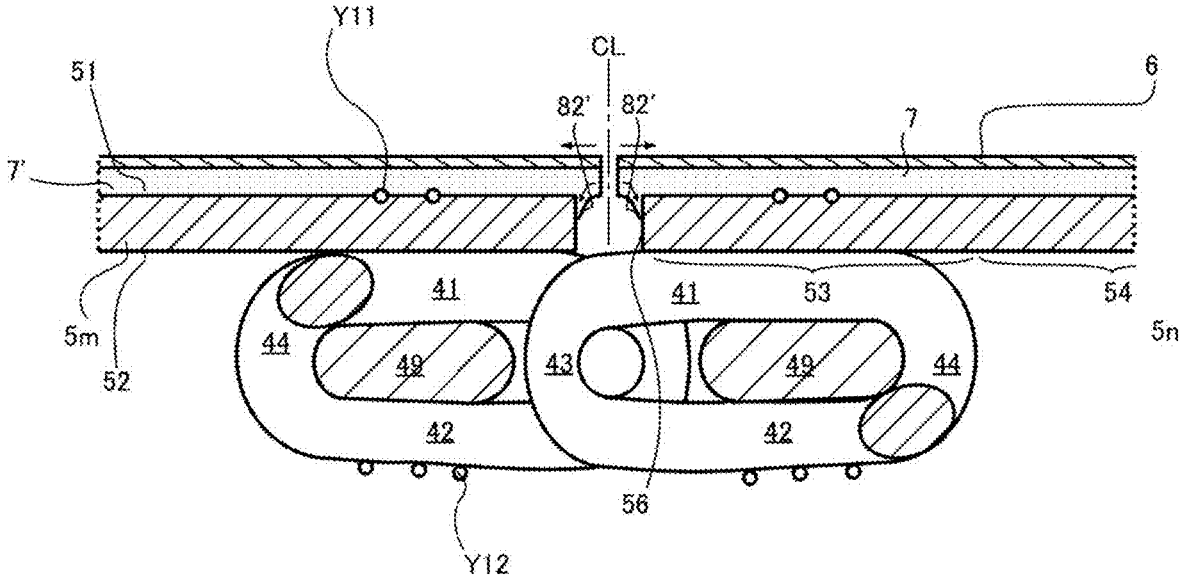

[Figure 13]
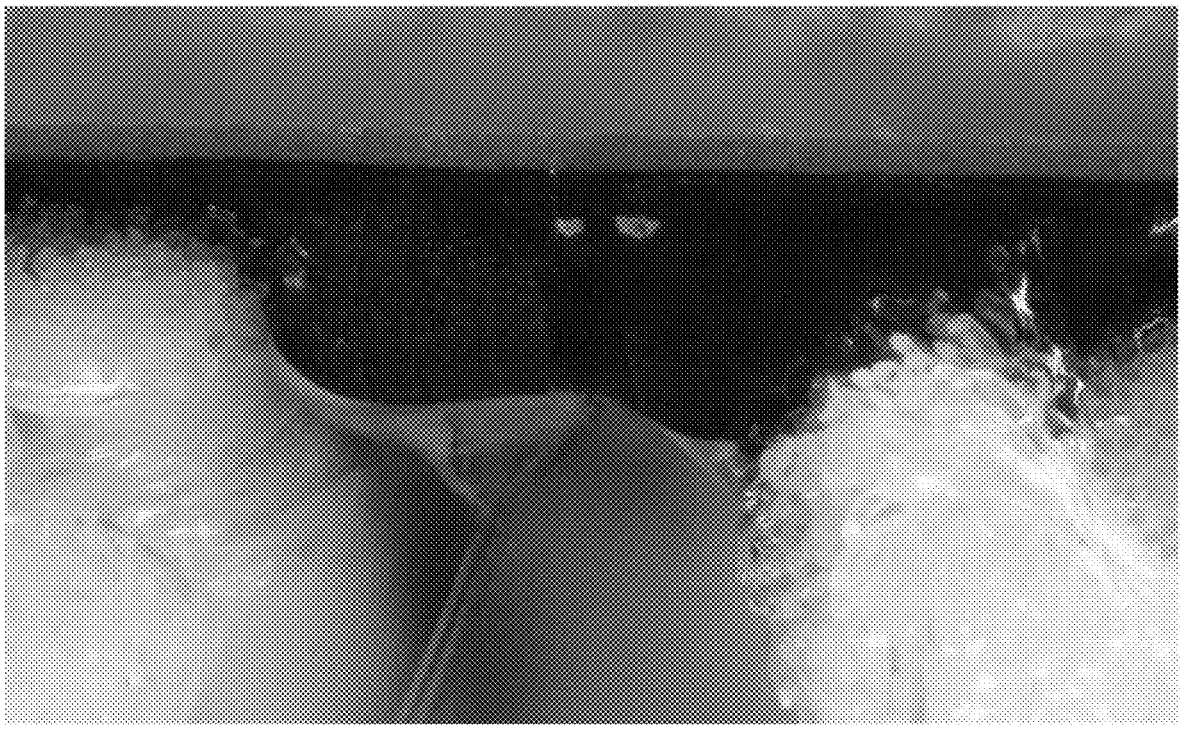

SLIDE FASTENER AND METHOD OF PRODUCING WATERPROOF CHAIN

CROSS-REFERENCE TO RELATED APPLICATIONS

This application claims a benefit of Japanese Patent Application No. 2022-159609 filed in Japan on Oct. 3, 2022, the entire content of which is hereby incorporated by reference.

FIELD OF THE DISCLOSURE

The present disclosure is related to a slide fastener and a method of producing waterproof chain.

BACKGROUND

International Publication No. 2021/048936 discloses a technique to overlay a film to a main portion of a fastener tape via a reactive hot-melt adhesive. The document discloses in its Para. 0094 that a tension is applied to the film in its longitudinal direction.

Japanese patent No. 4689631 discloses that a water or oil repellent is applied to a core thread. In this document, a liquid-tight layer such as a polyurethane film or the like is glued or adhered to a surface of fastener chain (See para. 0025 and 0034 thereof).

Japanese patent No. 3580725 discloses that a synthetic resin film consisting of a laminate of a low melting resin layer and a high melting resin layer is overlaid to a fastener tape, and the low melting resin layer adheres to the fastener tape. The document illustrates in its FIG. 7 a state where a side edge of the fastener tape is partially covered by the stack of synthetic resin films.

SUMMARY

Use of a thinner film for the waterproof film allows suppression of degraded softness of the fastener tape due to overlaying of the waterproof film thereto, and simultaneously allows facilitated reduction of weight of slide fastener. However, this may cause reduced likelihood of contact between opposing ends of the waterproof films, and may allow easier deformation of the ends of the waterproof films. For example, assuming that a slider has been repeatedly operated to open and close a slide fastener for a long period of time, the ends of the waterproof films may be deformed and in turn, the waterproofness of slide fastener may be degraded. The present inventors have newly identified a technical challenge to suppress deterioration of waterproofness of slide fastener despite of the use of thinner waterproof film.

Embodiment 1

Slide fastener according to an aspect of the present disclosure includes: a pair of waterproof stringers comprising a pair of woven and/or knitted fastener tapes, a pair of coil elements respectively secured to opposing side-edge portions of the pair of fastener tapes, and waterproof films respectively overlaid via adhesives (preferably a thermosetting adhesive) on tape top surfaces of the fastener tapes of the pair of fastener tapes; and a slider that moves forward to engage the pair of coil elements and moves rearward to disengage the pair of coil elements. Each of the waterproof films has a film edge positioned over a space between the opposing side-edge portions of the pair of fastener tapes, the film edge supported by a supporting portion made of adhesive solidified, the supporting portion partially occupying the space between the opposing side-edge portions of the pair of fastener tapes, and the supporting portion having a thickness greater than a thickness of the film edge (e.g. a thickness greater than twice a thickness of the film edge).

Embodiment 2

In Embodiment 1, the supporting portion includes a top portion located higher relative to the tape top surface of the fastener tape and a bottom portion protruding downward from the top portion between the opposing side-edge portions of the pair of fastener tapes, a maximum thickness of the bottom portion being greater than a thickness of the top portion.

Embodiment 3

In Embodiment 1 or 2, the thickness of the top portion is greater than 0 μm and equal to or less than 300 μm, and the thickness of the bottom portion is in a range between 100 μm and 400 μm.

Embodiment 4

In any one of Embodiments 1 to 3, a bottom surface of the supporting portion includes a sloped surface that is upwardly sloped toward a center line of the slide fastener.

Embodiment 5

In any one of Embodiments 1 to 4, the sloped surfaces at both sides of the center line of the slide fastener are arranged to form an obtuse angle therebetween or a low-profile inverted-V.

Embodiment 6

In any one of Embodiments 1 to 5, the supporting portion has a side surface that is continuous to a side surface of the film edge in up-down direction, and a width of the side surface of the supporting portion in up-down direction is greater than twice a width of the side surface of the film edge in up-down direction.

Embodiment 7

In any one of Embodiments 1 to 6, the supporting portion has a side surface that is continuous to a side surface of the film edge in up-down direction, and the supporting portion has a maximum thickness at a position farther away from the center line of the slide fastener than its side surface.

Embodiment 8

In any one of Embodiments 1 to 7, the adhesive is a thermosetting adhesive.

Embodiment 9

In any one of Embodiments 1 to 8, a thickness of the waterproof film is in a range between 20 μm and 100 μm.

Embodiment 10

In any one of Embodiments 1 to 9, a thickness of the supporting portion is in a range between 150 μm and 400 μm.

The above-described Embodiments 2 to 10 could be appreciated as a separate feature from the Embodiment 1 not requiring the Embodiment 1 as prerequisite.

Embodiment 11

Method of producing a waterproof chain according to another embodiment of the present disclosure includes a first step of overlaying a common waterproof film (having a predetermined thickness), via adhesive (preferably a thermosetting adhesive), onto tape top surfaces of both fastener tapes of a pair of fastener tapes of a fastener chain, the fastener chain including a pair of fastener stringers including the pair of fastener tapes which are woven and/or knitted and a pair of coil elements respectively secured to opposing side-edge portions of the pair of fastener tapes; and a second step of cutting the waterproof film by a cutting tool at a position directly over a space between the opposing side-edge portions of the pair of fastener tapes, wherein the waterproof film is cut while being supported by a supporting portion made of the adhesive, and the supporting portion partially occupies the space between the opposing side-edge portions of the pair of fastener tapes and has a thickness greater than a thickness of the waterproof film before or after said cutting of the waterproof film.

Embodiment 12

Also disclosed is a slide fastener including:

a first waterproof stringer comprising a woven and/or knitted first fastener tape, a first coil element secured to a first side-edge portion of the first fastener tape, and a first waterproof film overlaid via first adhesive on a tape top surface of the first fastener tape;

a second waterproof stringer comprising a woven and/or knitted second fastener tape, a second coil element secured to a second side-edge portion of the second fastener tape, and a second waterproof film overlaid via second adhesive on a tape top surface of the second fastener tape, the second side-edge portion opposing to the first side-edge portion; and a slider that moves forward to engage the first and second coil elements and moves rearward to disengage the first and second coil elements, wherein the first and second waterproof films have first and second film edges which are positioned over a space between the first and second opposing side-edge portions of the first and second fastener tapes, the first film edge supported by a first supporting portion made of the first adhesive solidified, the first supporting portion partially occupying the space between the first and second side-edge portions of the first and second fastener tapes, and the first supporting portion having a thickness greater than a thickness of the first film edge or greater than twice a thickness of the first film edge, and the second film edge supported by a second supporting portion made of the second adhesive solidified, the second supporting portion partially occupying the space between the first and second side-edge portions of the first and second fastener tapes, and the second supporting portion having a thickness greater than a thickness of the second film edge or greater than twice a thickness of the second film edge.

The above-described Embodiments 2-10 may be applied to the Embodiments 11 and 12. The above-described Embodiments 2-10 could be appreciated as a separate feature from the Embodiment 11 not requiring the Embodiment 11 as prerequisite.

BRIEF DESCRIPTION OF DRAWINGS

FIG. 1 is a schematic top view of slide fastener according to an aspect of the present disclosure.

FIG. 2 is a schematic partial bottom view of slide fastener, illustrating a state where coil elements are engaged.

FIG. 3 is a schematic cross-sectional view taken along a dash line III-Ill in FIG. 1, with an expanded view nearby a space between left and right fastener tapes.

FIG. 4 discloses a schematic view illustrating a condition where a coil element is sewn by sewing thread(s) to a ground structure of fastener tape.

FIG. 5 is a schematic view of internal structure of slider with an illustration of coil element introduced into element passage between a coupling pillar and a flange.

FIG. 6 is a schematic view illustrating an embodiment where water repellent adheres to a lower portion of the fastener tape.

FIG. 7 is a schematic process diagram for illustrating a process of production of slide fastener.

FIG. 8 is a schematic process diagram for illustrating a process of production of slide fastener.

FIG. 9 is a schematic view illustrating a condition where a tension is applied to a waterproof film.

FIG. 10 is a schematic view illustrating a condition after the tension applied to the waterproof film is removed.

FIG. 11 is another schematic view illustrating a condition where a tension is applied to a waterproof film.

FIG. 12 is a schematic view illustrating a condition after the waterproof film and the supporting portion in the state of FIG. 11 are cut.

FIG. 13 is a photograph of a sample in cross section, showing a state before the waterproof film is cut.

DETAILED DESCRIPTION

Hereinafter, non-limiting embodiments and features of the present invention would be discussed with reference to drawings. A skilled person would be able to combine respective embodiments and/or respective features without requiring excess description, and would appreciate synergistic effects of such combinations. Overlapping descriptions among the embodiments are basically omitted. Referenced drawings aim mainly for describing inventions and are simplified for the sake of convenience of illustration. The respective features should be appreciated as universal features not only effective to a slide fastener presently disclosed but also effective to other various slide fasteners not disclosed in the present specification.

In the present specification, a direction of movement of slider 9 for opening and closing a slide fastener 1 defines a front-rear direction. A direction parallel to a width direction of slide fastener 1 defines a left-right direction. A direction parallel to a thickness direction of slide fastener 1 defines an up-down direction. Note that the up-down direction is orthogonal to both of the front-rear direction and the left-right direction. The up-down direction does not necessarily indicate a vertical direction (a direction of gravity). For example, when the slide fastener 1 is oriented such that its elongation direction is aligned to a vertical direction, the up-down direction with respect to the slide fastener 1 would be in a horizontal direction (which is orthogonal to the vertical direction). As such, the directions in the present specification is irrelevant to the vertical direction. Note that, directions other than the front-rear direction, left-right direction, and up-down direction may be occasionally referred as described below.

Description follows with reference to FIGS. 1 to 5. Slide fastener 1 is a flexible elongated part extending longer in the front-rear direction with a constant width in the left-right direction, and has a pair of waterproof stringers (first and second waterproof stringers) 2*m*,2*n* and at least one slider 9. Each of the waterproof stringers 2*m*,2*n* has a coil element 4*m*,4*n*, a fastener tape 5*m*,5*n*, and a waterproof film 6*m*,6*n*. The coil elements 4*m* and 4*n* may be referred to as first and second coil elements. The same applies to the fastener tapes 5*m* and 5*n*, and the waterproof film 6*m* and 6*n*. The waterproof film 6*m*,6*n* is overlaid to the fastener tape 5*m*,5*n* via adhesive 7. As the slider 9 moves forward, the pair of coil elements 4*m*,4*n* are engaged (simultaneously the waterproof stringers 2*m*,2*n* are closed) and as the slider 9 moves rearward, the pair of coil elements 4*m*,4*n* are disengaged (simultaneously the waterproof stringers 2*m*,2*n* are open). Note that the fastener tapes 5*m*,5*n* are flat in the illustrated example but a fold may be formed nearby the center line CL to configure a so-called "conceal" slide fastener.

The pair of coil elements 4*m*,4*n* are attached, typically sewn by double chain stitch, to the opposing side-edge portions 53 of the first and second fastener tapes 5*m*,5*n*. These side-edge portions 53 may be referred to as first and second side-edge portions. Each coil element 4*m*,4*n* is made of a monofilament helically wound and includes a series of units U1 each consisting of a top leg 41, bottom leg 42, engagement head 43 and return portion 44 (See FIGS. 2-4). The engagement head 43 has a biting portion formed to be wider in the front-rear direction through plastic deformation of monofilament, allowing engagement between the left and right coil elements 4*m* and 4*n*. Core thread 49 may be inserted in the inside of the coil element 4*m*,4*n* to increase mechanical strength of the coil element 4*m*,4*n* or attachment strength to the fastener tape 5*m*,5*n* by sewing thread(s) Y1. In cases of double chain stitch, the sewing threads Y1 may include at least one needle thread Y11 and at least one looper thread Y12 (See FIG. 4).

The top leg 41 and the bottom leg 42 each extends in the width direction of the fastener tape 5*m*,5*n* and has a tape-outward end and a tape-inward end. The engagement head 43 extends in the up-down direction so as to interconnect the tape-outward end of the top leg 41 and the tape-outward end of the bottom leg 42. The return portion 44 extends to curve so as to interconnect the tape-inward end of the bottom leg 42 and the tape-inward end of the top leg 41 between adjacent units U1. Tape-outward indicates, regarding one fastener tape, a direction directed from a point on the tape surface of the fastener tape to a point outside of the tape surface of the fastener tape so as to cross (e.g. be orthogonal to) the opposing side-edge portion 53. Tape-inward indicates, regarding one fastener tape, a direction directed from a point outside of the tape surface of the fastener tape to a point on the tape surface of the fastener tape so as to cross (e.g. be orthogonal to) the opposing side-edge portion 53.

The slider 9 has a top wing 91, bottom wing 92 and coupling pillar 93 that couples these wings 91 and 92, not necessarily limited to this though. The coupling pillar 93 extends in the up-down direction between front end portions of the top and bottom wings 91 and 92 to interconnect them, thereby forming a Y-shaped element passage (See FIG. 5). Two front mouths are arranged at the both left and right sides of the coupling pillar 93 and one rear mouth is arranged opposite to these front mouths. Partition 91*a* elongated rearward from the coupling pillar 93 (See FIG. 5) can be provided in the top wing 91. The coil element 4*m*,4*n* (particularly the engagement head 43) may be brought into contact with the coupling pillar 93 of the slider 9. In cases where the elongated partition 91*a* is arranged as shown in FIG. 5, the film edge 65 and/or the supporting portion 8 described below may be in contact with the elongated partition 91*a* in the slider 9, possibly enhancing watertightness in the slider 9. Furthermore, the film edge 65 may withstand the contact with the elongated partition 91*a* as being reinforced by the supporting portion 8. Note that, the elongated partition 91*a* can be omitted as illustrated in FIG. 3.

Flanges 94 and 95 may be arranged in order to define the passage for the coil elements 4*m* and 4*n* in the width direction of the slide fastener 1. There are provided flanges 94 extending in the front-rear direction (and protruding upward) on left and right side-edges of the bottom wing 92. Also, there are provided flanges 95 extending in the front-rear direction (and protruding downward) on left and right side-edges of the top wing 91. The flanges 94 and 95 are arranged to face one another in the up-down direction, thereby forming a tape passage 96 through which the fastener tape 5*m*,5*n* is allowed to pass. Note that one of the flanges 94 and 95 may be omitted. Preferably, the height of the flange 94 is increased which is at a side where the coil element 4*m* and 4*n* is arranged relative to the fastener tape 5*m* and 5*n*, and the height of the flange 95 at the opposite side is decreased.

Now we return to FIG. 3 for further discussion. The fastener tape 5*m*,5*n* has a tape top surface 51 and a tape bottom surface 52 which define a thickness of the tape. The waterproof film 6*m*,6*n* is overlaid to the tape top surface 51 via adhesive 7. The coil element 4*m*,4*n* is arranged on the tape bottom surface 52. Furthermore, the fastener tape 5*m*,5*n* can be sectioned, in its width direction (left-right direction), into a side-edge portion 53 to which the coil element 4*m*,4*n* is attached and a tape main portion 54 of a remainder other than the side-edge portion 53, and the side-edge portion 53 may be narrower in width than the tape main portion 54.

The waterproof film 6*m*,6*n* may be a resin film (preferably a film made of thermosetting resin) which is liquid-impermeable such as water-impermeable. Advantageously, the waterproof film 6*m*,6*n* may be a polyurethane film, preferably with sufficient flexibility and mechanical strength. The waterproof film 6*m*,6*n* may be precoated, as a film, on a release paper, for example. In some cases, the top surface of the waterproof film 6*m*,6*n* has a higher degree of smoothness compared with its bottom surface. In another case, the top surface of the waterproof film 6*m*,6*n* is a non-smooth surface that is embossed (its bottom surface may be a smooth surface or non-smooth surface). The waterproof film 6*m*,6*n* may be a transparent film, which is preferably transparent to visible light (light in a visible wavelength range (360 nm to 830 nm)). For example, the transparent film has a transmittance of 70% or 80% or 90% or more for visible light. The waterproof film 6*m*,6*n* has a side surface 63 that extends along the center line CL of the slide fastener 1. The side surfaces 63 at the both left and right sides of the center line CL may face one another with a slight space therebetween or may partially touch one another (e.g. may touch locally in the up-down direction and/or the front-rear direction). The thickness of the waterproof film 6*m*,6*n* is preferably in a range between 20 μm and 100 μm, and more preferably in a range between 20 μm and 70 μm. The side surface 63 is a surface formed by cutting the waterproof film 6.

The waterproof film 6*m*,6*n* has a film edge 65 protruding toward the center line CL of the slide fastener 1 (away from the opposing side surface 56 of the fastener tape 5*m*,5*n*), and a film main portion 66 of a remainder other than the film edge 65. The film edges 65 of the first and second waterproof films 6*m* and 6*n* may be referred to as first and second film edges. Directly under the film edge 65, the fastener tape 5*m*,5*n* is not provided and a space S1 between the fastener tapes 5*m* and 5*n* is provided. Directly under the film main portion 66, the fastener tape 5*m*,5*n* is provided. Preferably, the waterproof film 6*m*,6*n* covers the entire area of the tape top surface 51 of the fastener tape 5*m*,5*n*.

The adhesive 7 may be thermoplastic or thermosetting adhesive. More preferably, the adhesive 7 is thermosetting, and is solidified as heat-initiated cross-linking reaction progresses and maintains its shape after the solidification (i.e. would not soften even at higher temperature again). The adhesive 7 is polyurethane resin, phenolic resin or epoxy resin, for example. The use of adhesive (e.g. polyurethane resin) of the same type as the waterproof film 6*m*,6*n* allows enhanced peel strength of the waterproof film 6*m*,6*n* from the fastener tape 5*m*,5*n*. In cases where the waterproof film 6*m*,6*n* is a transparent film, a transparent adhesive (e.g. containing no inorganic or organic pigment) may preferably be used for the adhesive 7, allowing better emergence of the color of fastener tape 5*m*,5*n*.

The adhesive 7 may be formed as an intermediate layer 71 between the fastener tape 5*m*,5*n* and the waterproof film 6*m*,6*n*. The thickness of the intermediate layer 71 is preferably in a range between 50 μm and 300 μm, and more preferably in a range between 120 μm and 200 μm. The thickness of the intermediate layer 71 may fluctuate in a given range. For example, the maximum thickness of the intermediate layer 71 may be greater than the thickness of the waterproof film 6*m*,6*n*, and the minimum thickness of the intermediate layer 71 may be less than the thickness of the waterproof film 6*m*,6*n*. The intermediate layer 71 may be formed across the entire area of the tape top surface of the fastener tape 5*m*,5*n* and alternatively, locally or partially formed on the entire area of the tape top surface of the fastener tape 5*m*,5*n*. The thickness of the intermediate layer 71 may vary in accordance with uneven surface due to weave and/or knit structure of ground threads of fastener tape or in accordance with penetration of adhesive into component filaments of respective ground thread(s).

In some cases, an adhesive sheet is overlaid to the bottom surface of the waterproof film 6*m*,6*n* in advance, or the adhesive is precoated as an adhesive layer thereon, and a laminate including at least the waterproof film 6*m*,6*n* and the adhesive is overlaid to the fastener tape 5*m*,5*n* and next the resultant laminate is pressed in the thickness direction. Envisaged is that the adhesive or the adhesive sheet penetrates into and is integrated with the structure of the fastener tape 5*m*,5*n*. In such a case, the intermediate layer 71 of the adhesive 7 between the fastener tape 5*m*,5*n* and the waterproof film 6*m*,6*n* may not be observed or not immediately observed.

In the present embodiment, the first and second waterproof films 6*m*,6*n* have first and second film edges 65 positioned over a space S1 between the opposing first and second side-edge portions 53 of the first and second fastener tapes 5*m*,5*n*. Each film edge 65 is supported by a supporting portion 8 made of the adhesive 7 that is solidified. Furthermore, the supporting portion 8 partially occupies the space S1 between the opposing first and second side-edge portions 53 of the first and second fastener tapes 5*m*,5*n* and has a thickness greater than a thickness of the film edge 65 (e.g. a thickness greater than twice a thickness of the film edge 65). That is, the supporting portion 8 partially occupies the space S1 and is thickened. This allows suppression in deterioration of waterproofness of slide fastener despite of the use of thinner waterproof film. The supporting portions 8 supporting the first and second film edges 65 may be referred to as first and second supporting portions.

In instances where a cutting tool is used to cut one sheet of waterproof film 6 into the waterproof films 6*m* and 6*n* and if the supporting portion 8 is thickened in advance of the cutting, the accuracy of cutting of the waterproof film 6 may be improved as the waterproof film 6 is stably supported by the supporting portion 8.

The supporting portion 8 would be formed to be thicker if the amount of adhesive 7 applied is increased or the laminate of the fastener tape 5*m*,5*n*, the adhesive 7 and the waterproof film 6*m*,6*n* is pressed with higher force. Preferably, the supporting portion 8 is formed to have a moderate thickness so as to avoid a problem of degraded softness of the fastener tape 5*m*,5*n* associated with solidification of the adhesive 7. The thickness of the supporting portion 8 may be greater than 1.1 times, 1.2 times, 1.3 times, 1.4 times, 1.5 times, 1.6 times, 1.7 times, 1.8 times, 1.9 times, or 2 times the thickness of the waterproof film 6*m*,6*n*, and may preferably be in a range between 150 μm and 400 μm, more preferably in a range between 150 μm and 300 μm. In some cases, the maximum thickness of the supporting portion 8 may be equal to or greater than 3 times the thickness of the film edge 65, allowing the film edge 65 to be supported more surely or more stably (typically, the thickness of the film edge 65 is equal to the thickness of the waterproof film 6*m*,6*n*). Preferably, the space S1 is regulated to be in a range between 200 μm and 600 μm between the fastener tapes 5*m* and 5*n*. Note that the supporting portion 8 may adhere to the entire area of the bottom surface of the film edge 65. Also, the supporting portion 8 may be formed to partially cover the opposing side surface 56 of the fastener tape 5*m*,5*n*, and may typically adhere to the fastener tape 5*m*,5*n* as the adhesive 7 penetrated into (inwardly of fastener tape directed from the space S1 toward the side-edge portion 53) and solidified in the structure of the fastener tape 5*m*,5*n*. The supporting portion 8 may include a top portion 88 located higher relative to the tape top surface 51 of the fastener tape 5*m*,5*n* and a bottom portion 89 protruding downward from the top portion 88 between the opposing side-edge portions 53 of the pair of fastener tapes 5*m*,5*n*. In FIG. 3, the thickness of the top portion 88 is equivalent to the thickness of the bottom portion 89, but should not be limited to this. In some cases, the maximum (or average) thickness of the bottom portion 89 is greater than the thickness of the top portion 88, thereby further facilitating increased thickness of the supporting portion 8. Note that, when the intermediate layer 71 of the adhesive 7 is formed between the waterproof film 6*m*,6*n* and the fastener tape 5*m*,5*n*, the top portion 88 would be a portion that is in the same layer as the intermediate layer 71 and may have a thickness in a range of the thickness of intermediate layer 71 (in a range between minimum thickness and maximum thickness thereof). Even if the maximum thickness of the bottom portion 89 is lesser than the thickness of the top portion 88, the waterproof film 6*m*,6*n* would be effectively supported by the supporting portion 8.

The thickness of the top portion 88 may preferably be greater than 0 μm and equal to or less than 300 μm, and more preferably in a range between 50 μm and 200 μm. The thickness of the bottom portion 89 may preferably be in a range between 100 μm and 400 μm, and more preferably in a range between 150 μm and 300 μm.

The supporting portion 8 (and the bottom portion 89 thereof) has a bottom surface 81 facing the coil element 4*m*,4*n* at an underneath position thereof, a side surface 83 continuous to the side surface 63 of the waterproof film 6*m*,6*n* (e.g. similarly extending along the center line CL of the slide fastener 1), and a top surface 84 adhered to the bottom surface of the waterproof film 6*m*,6*n*. The bottom surface 81 may include a sloped surface 82 that is upwardly sloped toward the center line CL of the slide fastener. The sloped surfaces 82 at both left and right sides of the center line CL form an obtuse angle θ or a low-profile inverted-V. The sloped surfaces 82 at both left and right sides do not necessarily have a same gradient and may have different gradients. The side surface 83 is a surface that is formed as the supporting portion 8' (See FIG. 9) is cut together with the waterproof film 6. Likewise the side surface 63 of the waterproof film 6*m*,6*n*, the side surface 83 extends continuously in the front-rear direction. The side surfaces 83 at the both left and right sides of the center line CL may face one another with a slight space therebetween or may touch one another partially (e.g. locally touch in the up-down direction and/or in the front-rear direction). The bottom surface 81 may be positioned closer to the tape top surface 51 of the fastener tape 5*m*,5*n* compared with the tape bottom surface 52. The supporting portion 8 has the bottom portion 89 additionally to the top portion 88, and thus the side surface 83 of the supporting portion 8 is downwardly extended, thereby increasing a likelihood of contact between the side surfaces 83 at the both left and right sides of the center line CL.

The width TH83 of the side surface 83 of the supporting portion 8 in the up-down direction may be greater than 2 times or 3 times or 4 times the width TH63 of the side surface 63 of the film edge 65 in the up-down direction. This allows increased likelihood of contact between the left and right supporting portions 8. Note that the width TH83 of the side surface 83 of the supporting portion 8 in the up-down direction may be less than 8 times or 7 times or 6 times the width TH63 of the side surface 63 of the film edge 65 in the up-down direction. Additionally or alternatively, the supporting portion 8 may have a maximum thickness TH8 at a position farther away from the center line CL of the slide fastener than its side surface 83, thereby enabling increased adhesion strength to the fastener tape 5*m*,5*n*. Note that, likewise the thickness of the waterproof film 6, the width TH63 of the side surface 63 of the film edge 65 in the up-down direction may be in a range between 20 μm and 100 μm, more preferably in a range between 20 μm and 70 μm. Likewise the thickness of the supporting portion 8, the width TH83 of the side surface 83 of the supporting portion 8 in the up-down direction may be in a range between 150 μm and 400 μm, more preferably in a range between 150 μm and 300 μm. The same applies to the maximum thickness TH8 of the supporting portion 8.

In cases where the sloped surfaces 82 at the both left and right sides are formed in a low-profile inverted-V defining an obtuse angle θ, a thickness of the supporting portion 8' (See FIG. 9) at the cutting position would be reduced to allow stable cutting, and/or a thickness of a portion of the supporting portion 8' adhering to the side surface 56 of the fastener tape 5*m*,5*n* would be increased to allow enhanced adhesion strength. The sloped surface 82 is formed between the side surface 83 of the supporting portion 8 and a position where the thickness of the supporting portion 8 is at the maximum. There may be cases where another sloped surface 85 is formed between the position where the thickness of the supporting portion 8 is at the maximum and the side surface 56 of the fastener tape 5*m*,5*n*. In these cases either, the adhesion strength of the supporting portion 8 to the fastener tape 5*m*,5*n* would be enhanced if the position where the thickness of the supporting portion 8 is at the maximum is near the side surface 56 of the fastener tape 5*m*,5*n*.

Preferably, a separation distance between the left and right side surfaces 83 is equal to or less than 60 μm, e.g. in a range between 0 μm and 30 μm. If the separation distance between the left and right side surfaces 83 is equal to 0, then indicated is that those side surfaces 83 are in contact. In cases where the left and right side surfaces 83 repeat periodic or non-periodic contact and noncontact along the elongation direction of the slide fastener 1, an average value of the separation distance between the surfaces 83 may be equal to or greater than 2 μm. For example, distance between the side surfaces 83 can be measured by 1 cm pitch in the slide fastener 1 having a length of 10 cm, and an average of the measurements can be calculated.

In some cases, the coupling pillar 93 is dimensioned to be thicker in the vicinity of interconnection with the top wing 91 as outlined by dotted line in FIG. 5. In such a case, the supporting portion 8 may be brought into contact with the wall surface of the coupling pillar 93, and watertightness may be enhanced. However, a sliding resistance for the slider 9 may likely increase. In connection to this aspect, the sloped surface 82 is formed in the bottom surface 81 of the supporting portion 8 as described above, allowing the supporting portion 8 to have a reduced contact area with the wall surface of the coupling pillar 93. Additionally or alternatively, as illustrated in FIG. 5, a partition 91*a* elongated rearward from the coupling pillar 93 may be formed so as to protrude downward from the bottom surface of the top wing 91. In this case, the supporting portion 8 may be brought into contact with the side surface of the elongated partition 91*a* to enhance watertightness but, similarly a sliding resistance for the slider 9 may likely increase. Likewise the above description, the sloped surface 82 is formed in the bottom surface 81 of the supporting portion 8, allowing the supporting portion 8 to have a reduced contact area with the wall surface of the coupling pillar 93. Note that the width of the elongated partition 91*a* in the left-right direction may be greater than a width of the space S1 in the left-right direction.

Now referring to FIG. 6 for further discussion. In some cases, as illustrated in FIG. 6, the adhesive 7 penetrates into and solidifies in the upper portion 58 of the fastener tape 5*m*,5*n*, making it impossible or harder for liquid to penetrate into the upper portion 58. Water repellent may adhere to the lower portion 59 of the fastener tape 5*m*,5*n* in order to prevent penetration of liquid through the fastener tape 5*m*,5*n* (e.g. formation of channel of liquid that penetrates through the structure of the fastener tape 5*m*,5*n* from the space S1 to the tape bottom surface 52 of the fastener tape 5*m*,5*n*). The water repellent may adhere not necessarily to the entire area of the lower portion 59 of the fastener tape 5*m*,5*n* but only to the opposing side-edge portion 53 of the fastener tape 5*m*,5*n*. Boundary between the upper portion 58 and the lower portion 59 of the fastener tape 5*m*,5*n* can be determined based on existence of the adhesive 7 (the illustrated linear boundary is drawn just for convenience of illustration). Various ways such as spray coating and immersion of the waterproof stringer 2*m*,2*n* into water repellent liquid can be adopted for a purpose of application of water repellent.

The water repellent may be applied after the waterproof film 6*m*,6*n* is overlaid to the fastener tape 5*m*,5*n* via the adhesive 7, allowing reduction of amount of water repellent used and allowing the water repellent to adhere to the core thread 49 and the coil element 4*m*,4*n* either, not necessarily limited to this process though. It would be possible to immerse the fastener tape 5*m*,5*n* in water repellent liquid beforehand and then overlay the waterproof film 6*m*,6*n* thereto. In this case, additionally to the structure of the fastener tape 5*m*,5*n* and the adhesive 7, the water repellent would exist in the upper portion 58 of the fastener tape 5*m*,5*n*. By way of precaution, application of water repellent can be omitted.

Operation of the slide fastener 1 would be discussed. As the slider 9 moves forward to engage the left and right coil elements 4*m* and 4*n*, the left and right fastener tapes 5*m* and 5*n* are not in contact due to a space S1 interposed. However, the film edges 65 of the waterproof films 6*m* and 6*n* are arranged directly over this space S2, preventing or suppressing fluid from entering into the space S1. Furthermore, the above-described supporting portion 8 adheres to the film edge 65. Therefore, inflow of liquid via a space between the film edges 65 would be further suppressed.

It is not a requisite for the film edges 65 at both left and right sides of the center line CL of the slide fastener 1 to be brought into contact but, they are expected to be in local or intermittent contact along the center line CL in the elongation direction of the slide fastener 1. The same holds true to the contact between the supporting portions 8 at both left and right sides of the center line CL of the slide fastener 1. Due to cutting by a cutting tool such as a cutter, the waterproof film 6*m*,6*n* may be partially scraped and the supporting portion 8 may also be partially scraped but, local or intermittent contact may still be caused.

Method of production of slide fastener 1 would be discussed. Firstly, a common waterproof film 6 is overlaid, via adhesive 7, to the tape top surfaces 51 of both of the fastener tapes 5*m*,5*n* of the fastener chain 10 (See FIG. 7). This step of overlaying may be performed by overlaying, to the fastener tape 5*m*,5*n*, a laminate in which the waterproof film 6 and an adhesive layer are stacked in this order on a release paper. The overlaying would be performed in such a manner that the adhesive layer and the fastener tape are brought into direct contact. In cases where the main surface of the release paper on which the waterproof film 6 is formed is a smooth surface, the top surface of the waterproof film 6 would be a smooth surface as the smooth surface of the release paper is transferred thereto. The waterproof film 6 and the adhesive layer both may be thermosetting resin, but not necessarily limited to this. Note that, the fastener chain 10 is configured from the waterproof stringers 2*m* and 2*n* in which the coil elements 4*m* and 4*n* are engaged.

Next, the waterproof film 6 is cut by a cutting tool 101 such as a cutter along the center line CL of the fastener chain 10 at a position directly over the space S1 between the opposing side-edge portions 53 of the fastener tapes 5*m*,5*n* (See FIG. 8). As such, a waterproof chain is obtained in which the waterproof films 6*m* and 6*n* are respectively overlaid to the fastener tapes 5*m* and 5*n*. Optionally, a presser (means for pressing) is used to press the waterproof stringer 2*m*,2*n* (a laminate of the waterproof film 6*m*,6*n*, the adhesive 7, and the fastener tape 5*m*,5*n*) in the thickness direction (in other words, the lamination direction of laminate), allowing the waterproof film 6*m*,6*n* to more firmly adhere to the fastener tape 5*m*,5*n* and facilitating the formation of supporting portion 8. The presser (means for pressing) may include one or more rolls such as a pressure roll urged by elastic means such as a spring. For example, the waterproof stringer 2*m*,2*n* is driven between the pressure roll and a transfer roll (with a rotational axis fixed at a predetermined position), and the waterproof stringer 2*m*,2*n* is pressed in its thickness direction. Other means for pressing may be employed.

In the step of overlaying, a tension may be applied at least to the waterproof film 6 in the width direction of the fastener chain 10 and the applied tension may be released. As illustrated in FIG. 9, the waterproof film 6 with adhesive 7 (a laminate of the waterproof film 6 and the adhesive sheet 7') may be pulled and stretched to both left and right sides away from the center line CL of the fastener chain 10 (See arrows in FIG. 9) and the stretched film 6 may be overlaid to the fastener tape 5*m*,5*n*. Once the applied tension is released, the waterproof film 6 slackens slightly out of the stretched state, and the fastener tape 5*m*,5*n* may be slightly displaced in a direction to approach the center line CL as illustrated in FIG. 10. As a result of this, the sloped surfaces 82' may be formed in the supporting portion 8' at both left and right sides of the center line CL.

Next, a cutting tool such as a cutter is used to cut the waterproof film 6 and the supporting portion 8' along the center line CL of the fastener chain 10. The waterproof film 6 is cut while being supported by the supporting portion 8' made of the adhesive 7 that is solidified. The supporting portion 8' is thickened as partially occupying the space S1 between the opposing side-edge portions 53 of the pair of fastener tapes 5*m*,5*n*. Therefore, the waterproof film 6 can be stably cut and accuracy of cutting can be improved. The space S1 is not fully occupied by the supporting portion 8', allowing the cutting edge of the cutting tool to be positioned at an appropriate depth in the space S1, thus facilitating the cutting of the waterproof film 6 without scratching the coil element 4*m*,4*n*. Furthermore, the supporting portion 8' is formed, particularly formed in contact with the side surfaces 56 of the tape side-edge portions 53, thereby facilitating the cutting without damaging the tape side-edge portions 53.

Method for forming the sloped surface 82' in the supporting portion 8' should not be limited to the above-discussed ways. It would be possible to pull the left and right fastener tapes 5*m* and 5*n*, to which the waterproof film 6 is attached, to both left and right sides as illustrated in FIG. 11 after the waterproof film 6 is stacked to the fastener tapes 5*m* and 5*n* via the adhesive 7 and before the adhesive 7 solidifies. This operation stretches the waterproof film 6 and in some cases, the waterproof film 6 would be thinner in the vicinity of the central portion thereof (e.g. a shallow concave is formed on the top surface of the waterproof film 6 (See FIG. 11)). When the waterproof film 6 is cut at its central portion (e.g. at the recess), the respective waterproof films 6 over the space S1 are displaced away from the center line CL of the fastener chain 10, and the adhesive 7 forming the supporting portion 8' may flow similarly, causing downward flow of the adhesive 7 along the side surface 56 of the fastener tape 5*m*,5*n* (See FIG. 12). As a result, the sloped surfaces 82' may be formed at both left and right sides of the center line CL.

FIG. 13 is a photograph showing the supporting portion between the fastener tapes according to a working example. For a purpose of easier understanding of structure, the fastener tape 5*m*, 5*n*, the waterproof film 6, the adhesive sheet 7' are colored differently, the configuration is same as that of an actual product though. State of the supporting portion 8 in the space S1 and formation of the supporting portion 8 from the adhesive would be well appreciated.

Based on the above disclosure, a skilled person in the art would be able to add various modifications to the respective features and embodiments. Reference numerals in Claims are just for reference and should not be referred for a purpose of narrowly construing the scope of claims.

REFERENCE NUMERALS

1: Slide fastener
2*m*: Waterproof stringer
2*n*: Waterproof stringer

4*m*: Coil element
4*n*: Coil element
5*m*: Fastener tape
5*n*: Fastener tape
6: Waterproof film
6*m*: Waterproof film
6*n*: Waterproof film
7: Adhesive
8: Supporting portion
8': Supporting portion
9: Slider
10: Fastener chain
51: Tape top surface
52: Tape bottom surface
53: Side-edge portion
58: Upper portion
59: Lower portion
65: Film edge
81: Bottom surface
82: Sloped surface
82': Sloped surface
84: Top surface
88: Upper portion
89: Lower portion
CL: Center line
CP1: Center line
S1: Clearance
θ: obtuse angle

The invention claimed is:

1. A slide fastener comprising:

a first waterproof stringer comprising a woven and/or knitted first fastener tape, a first coil element secured to a first side-edge portion of the first fastener tape, and a first waterproof film overlaid via a first adhesive on a tape top surface of the first fastener tape;

a second waterproof stringer comprising a woven and/or knitted second fastener tape, a second coil element secured to a second side-edge portion of the second fastener tape, and a second waterproof film overlaid via a second adhesive on a tape top surface of the second fastener tape, the second side-edge portion opposing to the first side-edge portion; and a slider that moves forward to engage the first and second coil elements and moves rearward to disengage the first and second coil elements, wherein the first and second waterproof films have first and second film edges which are positioned over a space between the first and second opposing side-edge portions of the first and second fastener tapes, the first film edge supported by a first supporting portion made of the first adhesive solidified, the first supporting portion partially occupying the space between the first and second side-edge portions of the first and second fastener tapes, and the first supporting portion having a thickness greater than a thickness of the first film edge or greater than twice a thickness of the first film edge, and the second film edge supported by a second supporting portion made of the second adhesive solidified, the second supporting portion partially occupying the space between the first and second side-edge portions of the first and second fastener tapes, and the second supporting portion having a thickness greater than a thickness of the second film edge or greater than twice a thickness of the second film edge.

2. The slide fastener of claim 1, wherein the first supporting portion includes a first top portion located higher relative to the tape top surface of the first fastener tape and a first bottom portion protruding downward from the first top portion, a maximum thickness of the first bottom portion being greater than a thickness of the first top portion, and/or the second supporting portion includes a second top portion located higher relative to the tape top surface of the second fastener tape and a second bottom portion protruding downward from the second top portion, a maximum thickness of the second bottom portion being greater than a thickness of the second top portion.

3. The slide fastener of claim 2, wherein the thickness of the first top portion is greater than 0 μm and equal to or less than 300 μm, and the thickness of the first bottom portion is in a range between 100 μm and 400 μm; and/or the thickness of the second top portion is greater than 0 μm and equal to or less than 300 μm, and the thickness of the second bottom portion is in a range between 100 μm and 400 μm.

4. The slide fastener of claim 1, wherein a bottom surface of the first supporting portion includes a first sloped surface that is upwardly sloped toward a center line of the slide fastener; and/or a bottom surface of the second supporting portion includes a second sloped surface that is upwardly sloped toward a center line of the slide fastener.

5. The slide fastener of claim 4, wherein the first and second sloped surfaces are arranged to form an obtuse angle therebetween or a low-profile inverted-V.

6. The slide fastener of claim 1, wherein the first supporting portion has a first side surface that is continuous to a first side surface of the first film edge in an up-down direction, and a width of the first side surface of the first supporting portion in the up-down direction is greater than twice a width of the first side surface of the first film edge in the up-down direction; and/or the second supporting portion has a second side surface that is continuous to a second side surface of the second film edge in an up-down direction, and a width of the second side surface of the second supporting portion in the up-down direction is greater than twice a width of the second side surface of the second film edge in the up-down direction.

7. The slide fastener of claim 1, wherein the first supporting portion has a first side surface that is continuous to a side surface of the first film edge in an up-down direction, and the first supporting portion has a maximum thickness at a position farther away from a center line of the slide fastener than the first side surface of the first supporting portion; and/or the second supporting portion has a second side surface that is continuous to a side surface of the second film edge in an up-down direction, and the second supporting portion has a maximum thickness at a position farther away from the center line of the slide fastener than the second side surface of the second supporting portion.

8. The slide fastener of claim 1, wherein the first and second adhesives are thermosetting adhesive.

9. The slide fastener of claim 1, wherein each thickness of the first and second waterproof films is in a range between 20 μm and 100 μm.

10. The slide fastener of claim 9, wherein each thickness of the first and second supporting portions is in a range between 150 μm and 400 μm.

11. The slide fastener of claim 1, wherein a bottom surface of the first supporting portion is positioned closer to the tape top surface of the first fastener tape than a tape bottom surface of the first fastener tape; and/or a bottom surface of the second supporting portion is positioned closer to the tape top surface of the second fastener tape than a tape bottom surface of the second fastener tape.

12. The slide fastener of claim 1, wherein a maximum thickness of the first supporting portion is equal to or greater than 3 times a thickness of the first film edge; and/or a maximum thickness of the second supporting portion is equal to or greater than 3 times a thickness of the second film edge.

13. The slide fastener of claim 1, wherein the first adhesive penetrates into and solidifies in a structure of the first fastener tape, thereby the first supporting portion adhering to the first fastener tape; and/or the second adhesive penetrates into and solidifies in a structure of the second fastener tape, thereby the second supporting portion adhering to the second fastener tape.

14. The slide fastener of claim 1, wherein the first fastener tape includes an upper portion into which the first adhesive penetrates and a lower portion to which a first water repellent adheres; and/or the second fastener tape includes an upper portion into which the second adhesive penetrates and a lower portion to which a second water repellent adheres.

15. The slide fastener of claim 14, wherein the upper portion of the first fastener tape does not include the first water repellent; and/or the upper portion of the second fastener tape does not include the second water repellent.

16. The slide fastener of claim 1, wherein the first supporting portion consists of the first adhesive only; and/or the second supporting portion consists of the second adhesive only.

17. A method of producing a waterproof chain, the method comprising:

overlaying a common waterproof film having a predetermined thickness, via an adhesive, onto tape top surfaces of both fastener tapes of a pair of fastener tapes of a fastener chain, the fastener chain including a pair of fastener stringers including the pair of fastener tapes which are woven and/or knitted and a pair of coil elements respectively secured to opposing side-edge portions of the pair of fastener tapes; and cutting the waterproof film by a cutting tool at a position directly over a space between the opposing side-edge portions of the pair of fastener tapes, wherein the waterproof film is cut while being supported by a supporting portion made of the adhesive, and the supporting portion partially occupies the space between the opposing side-edge portions of the pair of fastener tapes and has a thickness greater than twice a thickness of the waterproof film before or after said cutting of the waterproof film.

18. The method of producing a waterproof chain of claim 17, wherein the adhesive is precoated on a bottom surface of the waterproof film.

19. The method of producing a waterproof chain of claim 17, wherein in said overlaying, a tension is applied at least to the waterproof film along a width direction of the fastener chain.

20. The method of producing a waterproof chain of claim 17, the method further comprising pressing a laminate of the waterproof film, the adhesive and the fastener tape in its lamination direction.

* * * * *